United States Patent [19]

Dudley

[11] 4,376,321

[45] Mar. 15, 1983

[54] AUTOMATIC DRAIN CLEAN OUT DEVICE

[76] Inventor: Jack Dudley, 2784 Beck St., Warren, Ohio 44484

[21] Appl. No.: 265,380

[22] Filed: May 20, 1981

[51] Int. Cl.[3] ..... B08B 9/02

[52] U.S. Cl. ..... 15/104.3 SN; 15/104.1 R

[58] Field of Search ..... 15/104.09, 104.1 R, 15/104.3 R, 104.3 SN; 4/255

[56] References Cited

U.S. PATENT DOCUMENTS

| | | | |
|---|---|---|---|
| 1,796,340 | 3/1931 | Nowakowski | 15/104.3 SN |
| 2,039,467 | 5/1936 | Walsh | 15/104.3 SN |
| 2,454,884 | 11/1948 | Peaden | 15/104.3 SN |
| 2,610,696 | 9/1952 | Mayberry | 15/104.3 SN |
| 2,651,067 | 9/1953 | Collison | 15/104.3 SN |
| 3,124,820 | 3/1964 | Berry | 15/104.09 |

*Primary Examiner*—Edward L. Roberts

[57] ABSTRACT

An automatic drain clean out device for use on sinks and the like is permanently mounted in the waste drain to dislodge waste passing through the drain so that there will be no build up of material. The automatic drain clean out device comprises an electric motor and a resilient snake attached thereto. The snake has elongated flexible fins throughout its length.

3 Claims, 4 Drawing Figures

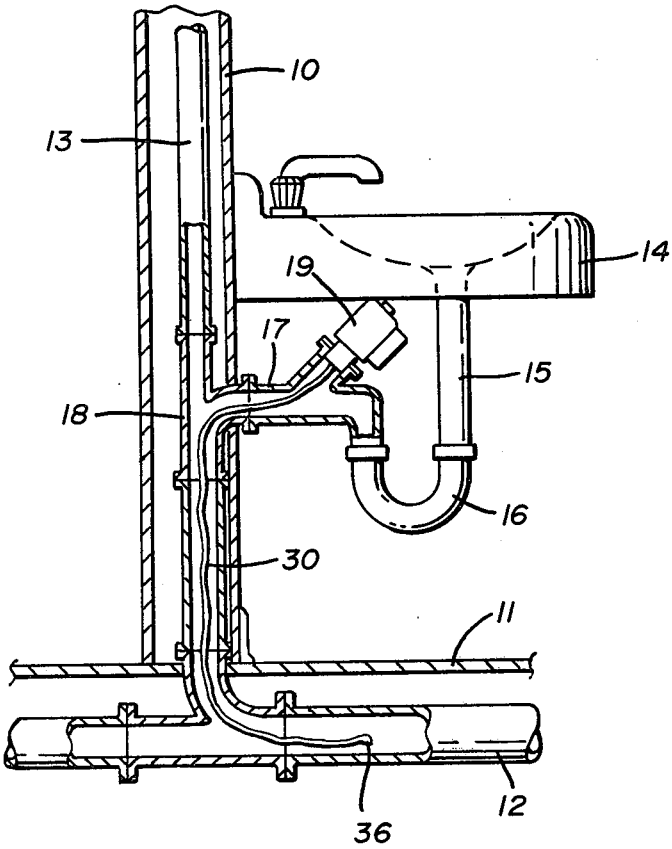
FIG. 1
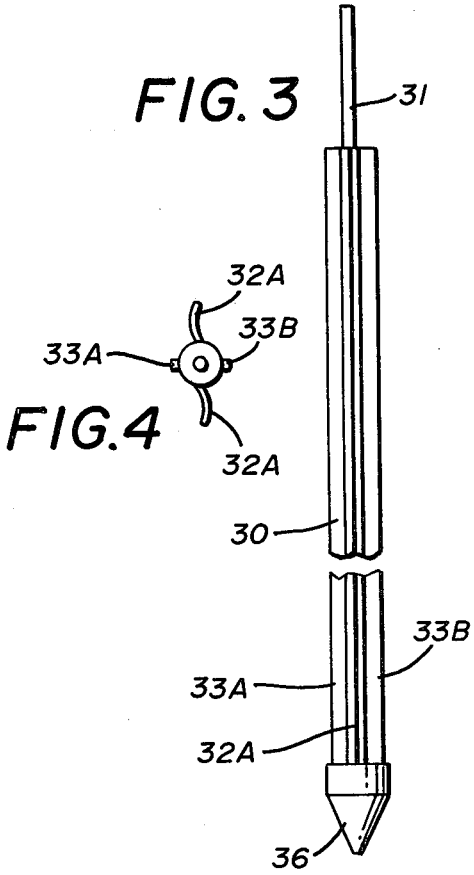
FIG. 3
FIG. 4
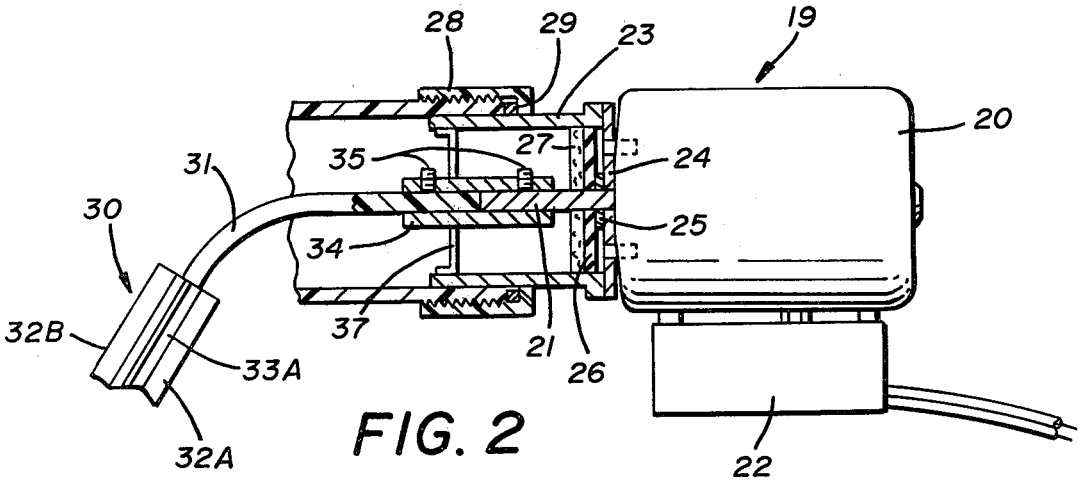
FIG. 2

AUTOMATIC DRAIN CLEAN OUT DEVICE

BACKGROUND OF THE INVENTION (1) Field of the Invention:

This invention relates to waste drain and conduit cleaning devices used to prevent the accumulation and obstructions in the drain.

(2) Description of the Prior Art:

Prior art devices have used manually operated metal snakes positioned in the drain lines. See for example U.S. Pat. Nos. 2,039,467, 2,454,884 and 2,610,696.

In U.S. Pat. No. 2,039,467 a coil spring is attached to a handle mounted in the drain line before the trap and extends down into the drain.

In U.S. Pat. No. 2,454,884, a cleaning device is shown having a hand crank connected to an offset elongated scraper which rotates within the drain pipe.

U.S. Pat. No. 2,610,696 discloses a drain trap scraper wherein a flexible coiled wire is fixed at one end to a shaft that is rotated by hand or with a motor.

Applicant's device utilizes a one-piece nylon snake inserted into the drain pipe and driven by a timer controlled motor. The device is permanently mounted in the drain pipe system and is preset to run periodically. The snake has oppositely disposed longitudinally flexible fins extending the length thereof to increase the dislodging action created by the rotation of the snake.

SUMMARY OF THE INVENTION

An automatic drain clean out device is permanently mounted in a drain system. The device utilizes a timer controlled motor connected to a flexible snake for rotating the same at relatively high rpms in the drain pipe for improved clean out action. The device prevents the drain from being clogged by build up of waste material therein.

DESCRIPTION OF THE DRAWINGS

FIG. 1 is a side elevational view with parts broken away and parts in cross section showing a typical under sink installation of the invention in a drain system;

FIG. 2 is an enlarged view of a portion of the device of FIG. 1 with parts in cross section;

FIG. 3 is a side view of a snake used in the device shown in FIG. 1; and FIG. 4 is an end view of the snake shown in FIG. 3.

DESCRIPTION OF THE PREFERRED EMBODIMENT

By referring to FIG. 1 of the drawings, a portion of a vertical wall 10 can be seen supported by a floor 11. A horizontal drain pipe 12 runs under the floor 11 and is connected to a vertical drain pipe 13 within the wall 10. A sink 14 is mounted on the wall 10 and has an outlet pipe 15 extending therefrom. A drain trap 16 connects the outlet pipe 15 with an adaptor fitting 17 which in turn communicates with a pipe fitting 18 in the vertical drain pipe 13. The adaptor fitting 17 is bifurcated, one portion of which is open to receive an automatic drain clean out device 19 as best seen in FIG. 2 of the drawings. The automatic drain clean out device 19 includes an electric motor 20 having a drive shaft 21 extending from one end. A timer 22 is attached to and controls said motor 20 providing intermittent operation of the same, and a power source is provided.

A water tight seal between the motor 20 and the adaptor fitting 17 is provided by an annular fitting 23 having an apertured mounting plate 24 secured to the motor 19. The drive shaft 21 extends through the aperture in the mounting plate 24 and has felt and rubber washers 25 and 26 respectively thereabout. A gasket 27 of silicon sealant material is positioned around the drive shaft 21 adjacent the rubber washer 25 forming a water tight seal. The annular fitting 23 has a threaded slip fit frictional ring 28 thereon and a gasket seal 29 that will engage and hold the annular fitting 23 within the adaptor fitting 17 which is externally threaded as the frictional ring 28 is turned thereon.

A snake 30 comprising an elongated member 31 is attached to the drive shaft 21 of the motor 20 and has oppositely disposed elongated flexible fins 32A and 32B integrally formed thereon as best seen in FIGS. 2 and 3 of the drawings.

A pair of oppositely disposed elongated ribs 33A and 33B are formed on the member 31 between the fins 32A and 32B and have a generally square cross sectional configuration for reduced flexibility as compared with said fins 32A and 32B. One end portion of the member 31 has no fins or tabs thereon and is secured to the end of the drive shaft 21 by a coupling 34 by a pair of set screws 35. The other end of the member 31 has a tapered cap 36 secured thereto as best seen in FIG. 3 of the drawings.

An apertured disc 37 is positioned within one end of the annular fitting 23 opposite the mounting plate 24. The coupling 34 extends through the aperture so as to limit the amount of water entering the annular fitting 23.

In use, the automatic drain clean out device 19 is mounted on the adaptor fitting 17 with the snake 30 extending into the drain pipes 12 and 13. The snake is made from a flexible resilient plastic material such as nylon and is rotated by the motor 20 in a high speed twisting, scraping motion which is necessary in order to obtain a desired cleaning action of the drain pipes. The invention can be used on many different drain pipe systems providing an automatic maintenance of the pipes, thus avoiding the cost and inconvenience of clogged pipes in a drainage system.

It will thus be seen that a new and useful automatic drain clean out device has been illustrated and described and that various changes and modifications can be made herein without departing from the spirit of the invention and having thus described my invention what I claim is:

1. An automatic drain clean out device comprising a longitudinally extending flexible snake, oppositely disposed longitudinally extending integral fins on said snake, oppositely disposed longitudinally extending ribs on said snake positioned between said fins, means for positioning said snake in a drain pipe and rotating the same therein, a bifurcated fitting in said drain pipe, a seal in a portion of said fitting, said means for positioning and rotating said snake being rotatable in said fitting and extending through said seal, said oppositely disposed longitudinally extending ribs being less flexible than said fins.

2. The automatic drain clean out device of claim 1 wherein said flexible snake is an elongated one piece member of a known width and said oppositely disposed flexible fins are of a transverse dimension greater than the known width of said member.

3. The automatic drain clean out device of claim 1 wherein said means for positioning and rotating said snake is an electric motor and a timer is connected in a circuit with said motor and a power source.

* * * * *